United States Patent [19]

Komotzki

[11] Patent Number: 5,071,195

[45] Date of Patent: Dec. 10, 1991

[54] TOOL AND NOZZLE SUPPORTING DEVICE FOR USE IN MINING MACHINES

[76] Inventor: Michael Komotzki, Vöhdeweg 46, D-4607 Kamen-Heeren-Werve, Fed. Rep. of Germany

[21] Appl. No.: 585,394

[22] Filed: Sep. 20, 1990

[51] Int. Cl.[5] ..... E21C 35/22

[52] U.S. Cl. ..... 299/81; 175/424; 299/92

[58] Field of Search ..... 299/17, 79, 81, 86, 299/91, 92, 93; 175/393, 424

[56] References Cited

U.S. PATENT DOCUMENTS

| | | | |
|---|---|---|---|
| 3,865,437 | 2/1975 | Crosby | 299/86 |
| 4,070,064 | 1/1978 | Cobb et al. | 299/81 |
| 4,280,735 | 7/1981 | Löbbe | 299/81 |
| 4,978,173 | 12/1990 | Rothkegel | 299/81 |

FOREIGN PATENT DOCUMENTS

| | | |
|---|---|---|
| 0067145 | 7/1984 | European Pat. Off. . |
| 3630636 | 10/1987 | Fed. Rep. of Germany . |
| 3902222 | 6/1990 | Fed. Rep. of Germany . |

OTHER PUBLICATIONS

"Kurznachrichten aus Bergtechnik und Kohlenveredelung", p. 3, Aug. 1985 (No. 117).

*Primary Examiner*—David J. Bagnell

*Attorney, Agent, or Firm*—Peter K. Kontler

[57] ABSTRACT

A tool supporting device for use in mining machines has a base abutting a tool holder which is biased against the base by a wedge-like resilient coupling member. The abutting surfaces of the base and tool holder have aligned holes including a blind hole in the base and a stepped through hole in the holder. The bottom surface in the blind hole serves as an abutment for an annular elastic sealing element which is deformed by the rear portion of a nozzle having an orifice in the through hole and an external shoulder which abuts an internal shoulder between the larger-diameter and smaller-diameter sections of the through hole. When the two shoulders abut each other and the tool holder is coupled to the base, the rear portion of the nozzle deforms the sealing element to prevent leakage of coolant, such as water, from a liquid-supplying channel which is provided in the base and has a discharge end in the bottom surface in register with the inlet of the nozzle. The tool holder has a socket which is adjacent the through hole and serves to receive the shank of a material removing tool, such as a bit.

10 Claims, 1 Drawing Sheet

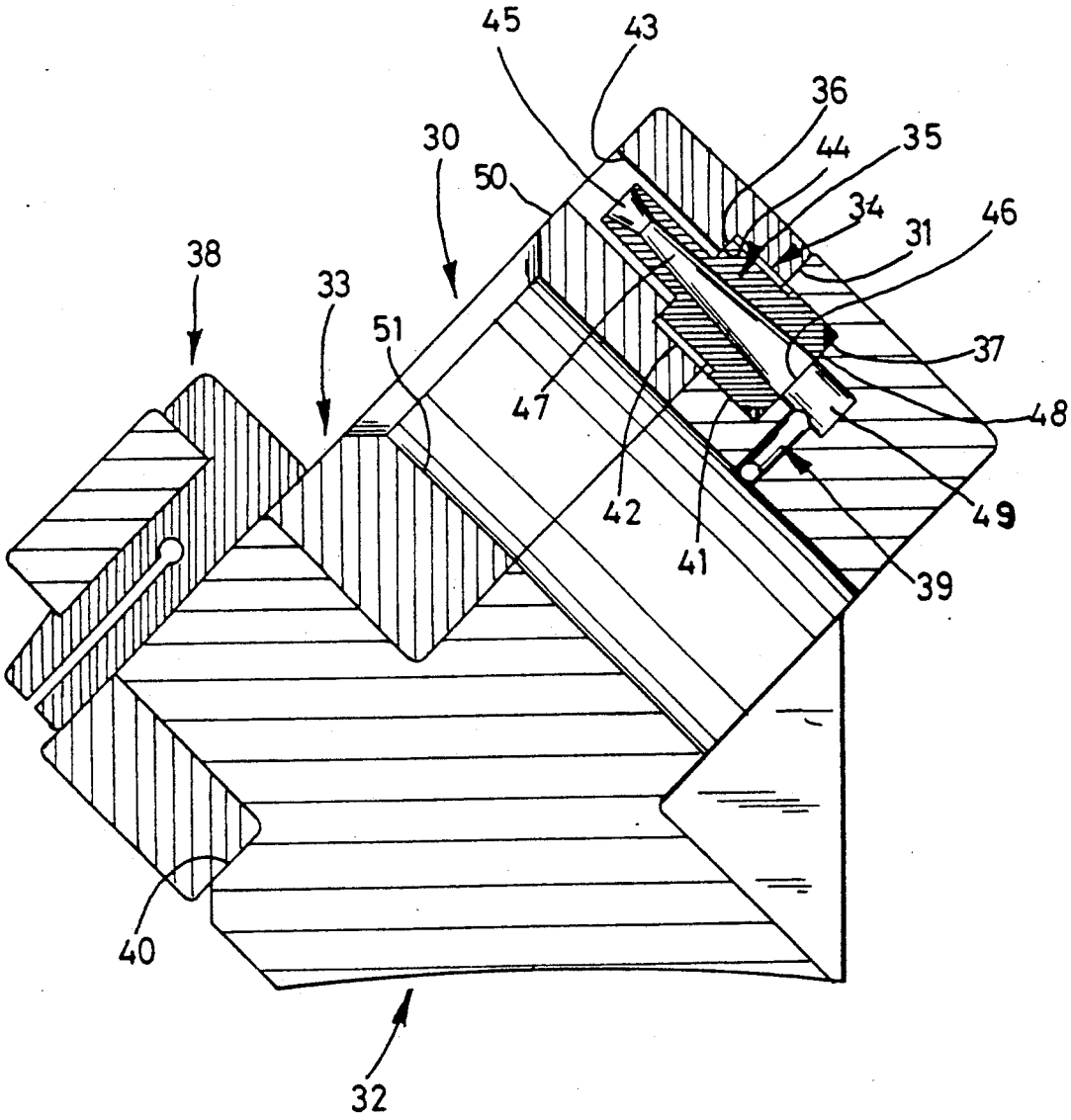
45
43
36
44
35
34
31
46
30
50
38
33
51
37
47
48
42
49
41
39
40
32

TOOL AND NOZZLE SUPPORTING DEVICE FOR USE IN MINING MACHINES

BACKGROUND OF THE INVENTION

The invention relates to improvements in material removing machines in general, and more particularly to improvements in devices for releasably mounting tools in material removing machines. Still more particularly, the invention relates to improvements in tool mounting devices which can be utilized with advantage in underground mining machines, for example, in so-called longwall shearing and/or heading machines.

It is often necessary to cool the tool which is used in a mining machine to remove material from the mine face and/or to cool the path or track which is cut into rock, coal or other material by a moving bit or another suitable tool, e.g., a tool of the type described and shown in European Pat. No. 0 067 145 granted to Zitz et al. The patent proposes to install in the tool holder a nozzle adjacent the bit so that the stream of water or another coolant which is used in the material removing machine can be directed against the working end of the tool or in another desired direction. In order to avoid waste of coolant, the patentees propose to mount the tool in its holder in such a way that the rear end of the tool shank initiates the admission of coolant to the nozzle when the tool is in the process of removing material, e.g., in an underground excavation. The purpose of the coolant is manifold. Thus, the coolant can impinge upon the tip of the tool and/or upon the material to be cut, and it can also serve to prevent the development of excessive quantities of dust which could affect the comfort and health of workers in an underground excavation. The tool has limited freedom of axial movement in its holder and is depressed in response to engagement with the material to be removed whereby the rear end of the tool shank initiates the admission of coolant to the nozzle which is adjacent the working end of the tool and is mounted in the tool holder.

The nozzle which is used in the tool holder of Zitz et al. is provided with external threads which mate with the threads in a tapped bore of the tool holder. Reference may also be had to page 3 of the August 1985 edition (No. 117) of the German-language publication entitled "Kurznachrichten aus Bergtechnik und Kohlenveredelung". A drawback of such mounting of the nozzle is that mechanical stresses to which the nozzle is subjected in actual use of the material removing tool are very pronounced so the external threads of the nozzle and/or the internal threads of the tool holder are likely to be damaged. Consequently, the nozzle cannot be readily removed from its holder which creates many problems and can cause lengthy interruptions of operation of the machine which employs such tool holders and nozzles.

Commonly owned earlier filed German patent application No. P 39 02 222 discloses a tool holder which constitutes a modification of the tool holder of Zitz et al. The difference is that the tool holder of the earlier filed commonly owned patent application contains a valve which can be opened to admit coolant to the nozzle in response to axial displacement of the tool but the valve is not operatively connected to the shank of the tool. Instead, the tool holder contains a reciprocable pusher which can be moved by the head of the material removing tool to thereby open the valve and admit coolant to the nozzle when the working end of the tool engages the material of a mine face. An advantage of such mode of controlling the admission of coolant to the nozzle is that the exact length of the tool shank is of no consequence.

Presently known holders for material removing tools which must be cooled during engagement with a mine face or the like exhibit certain additional drawbacks. For example, proper sealing of the nozzle in the tool holder often presents many problems, especially if the nozzle is mounted in two separable parts of the tool holder. German Pat. No. 36 30 636 to Beyer discloses a material removing tool mounted in a holder adjacent a nozzle which must be tilted in response to axial displacement of the tool as a result of penetration into the material of a mine face or the like. Tilting of the nozzle establishes communication between the inlet of the nozzle and a coolant-supplying channel in the tool holder. Such tiltability of the nozzle creates problems in connection with proper sealing of the path for the flow of coolant from the source, through the holder and into the tilted nozzle. The latter is tilted by a leaf spring which is carried by the shank of the tool and is flattened in response to rearward movement of the tool to thereby change the orientation of the nozzle.

OBJECTS OF THE INVENTION

An object of the invention is to provide a novel and improved tool mounting device which is constructed and assembled in such a way that the nozzle or nozzles which supply coolant or another fluid against or adjacent the working end of the material removing tool need not be provided with threads in order to be properly affixed to the support for the tool.

Another object of the invention is to provide a device wherein the nozzle need not be tilted and/or otherwise moved in order to discharge one or more streams of coolant or another fluid in a desired direction.

A further object of the invention is to provide a device which is constructed and assembled in such a way that the nozzle or nozzles are readily accessible and removable for inspection, cleaning or replacement.

An additional object of the invention is to provide a device wherein the nozzle is automatically moved into sealing engagement with the adjacent components as soon as the device is properly assembled.

Still another object of the invention is to provide novel and improved means for sealing the nozzle in the supporting structure for the material removing tool.

A further object of the invention is to provide a device which can employ a simple and inexpensive nozzle and wherein the nozzle is mounted in such a way that it is unlikely to be damaged by material which is being removed by the tool in an underground excavation, in a quarry or at any other locale of use.

An additional object of the invention is to provide a novel and improved method of confining the nozzle in the support for a material removing tool in a mining machine or the like.

Another object of the invention is to provide a mining or other material removing machine which employs the above outlined device.

A further object of the invention is to provide a device wherein the nozzle can constitute or form part of the means for preventing leakage of coolant or another conveyed fluid from the prescribed path for the flow of such fluid toward the working end of the material removing tool and/or in one or more other directions.

SUMMARY OF THE INVENTION

The invention resides in the provision of a device for mounting a material removing tool (such as a bit) for use in a mining machine, e.g., in a longwall shearing and/or heading machine. The improved device comprises a base having a preferably plane first surface and a first hole (e.g., a cylindrical blind bore) in the first surface, and a tool holder having a preferably plane second surface which abuts the first surface and a through hole (e.g., a cylindrical bore) including a first section having a first cross-sectional area and being aligned with and adjacent to and communicating with the first hole and a second section having a smaller second cross-sectional area and being spaced apart from the first and second surfaces. The tool holder also comprises a first stop (e.g., an annular internal shoulder between the first and second sections of the through hole). The improved device further comprises means for releasably coupling the holder to the base and a nozzle which is provided in the holes and has a second stop which abuts the first stop between the first and second sections of the through hole.

The nozzle has at least one orifice in the second section of the through hole, an inlet in the first hole and at least one passage between the inlet and the at least one orifice. The base has a fluid-supplying channel which communicates with the inlet of the nozzle. The bottom surface of the base at that end of the first hole which is remote from the first surface is provided with an opening which constitutes the discharge end of the aforementioned channel, and such opening is surrounded by an elastic annular sealing element which is interposed between the bottom surface and the adjacent portion of the nozzle to undergo deformation in response to coupling of the tool holder to the base and as a result of engagement of the second stop (e.g., an external annular shoulder of the nozzle) with the first stop. This ensures that the fluid (e.g., cold water) which is supplied by the channel and flows through the nozzle to issue from the orifice cannot leak from the discharge end of the channel, around that portion of the nozzle which is located in the first hole and into the first section of the through hole and/or between the first and second surfaces.

The stops are preferably designed to seal the first and second sections of the through hole from each other so that contaminants or fluid which is discharged by the orifice of the nozzle cannot penetrate into the first section of the through hole and between the first and second surfaces.

The holder has an additional surface which is or can be parallel to the second surface, and the through hole extends all the way between the second and additional surfaces of the holder. The additional surface of the holder is provided with a socket (e.g., in the form of a through bore or hole) for the shank of a material removing tool the working end of which is adjacent the additional surface. The fluid which is discharged from the orifice of the nozzle and issues from the second section of the through hole at the additional surface of the holder flows adjacent the tool so that it can cool the working end of the tool and/or the material around the path which is cut by the tool when the improved device is in actual use.

The coupling means can comprise means for biasing the first and second surfaces against each other.

The novel features which are considered as characteristic of the invention are set forth in particular in the appended claims. The improved device itself, however, both as to its construction and the mode of assembling and using the same, together with additional features and advantages thereof, will be best understood upon perusal of the following detailed description of certain presently preferred specific embodiments with reference to the accompanying drawing.

BRIEF DESCRIPTION OF THE DRAWING

The single FIGURE of the drawing is a sectional view of a tool mounting device which embodies one form of the invention and can be utilized in a mining machine, such as a longwall shearing and/or heading machine, the tool holder being releasably coupled to the base and the nozzle being inserted into the aligned holes of the base and tool holder.

DESCRIPTION OF PREFERRED EMBODIMENTS

The improved tool- and nozzle-supporting or mounting device comprises a base 32 which can be mounted in a mining machine and has a plane surface 40 abutting the plane surface 31 of a tool holder 33. The means 38 for releasably coupling the holder 33 to the base 32 so that the surface 34 abuts the surface 40 includes a resilient wedge-like member which is designed to bias the tool holder against the base. The details of the coupling means 38, as well as certain additional details of a presently preferred base and of a presently preferred tool holder are described, claimed and shown in the commonly owned copending U.S. patent application Ser. No. 07/585,393 filed Sept. 20, 1990 for "Device for releasably mounting tools in mining machines".

The tool holder 33 has an additional surface 50 which is or can be substantially parallel to the surface 31 and is provided with a socket 51 (e.g., a through bore or hole which also extends all the way through the adjacent portion of the base 32) for a material removing tool, e.g., a tool of the type shown in U.S. Pat. No. 3,865,437 to Crosby. The working end of the properly inserted tool is located at 30, and the stem or shank of the tool extends into and is releasably anchored in the socket 51.

The surface 40 of the base 32 is provided with a cylindrical blind bore or hole 41 which extends to an annular bottom surface 48 in the base 32, and the tool holder 33 is provided with a cylindrical through hole or bore 34 which extends all the way between the surfaces 31 and 50. The hole 34 includes a larger-diameter section 42 which is aligned with and communicates with the hole 41 in the surface 40, and a smaller-diameter section 43 which extends all the way to the surface 50. The holder 33 has an internal stop 44 in the form of an annular shoulder which is disposed between the sections 42, 43 of the hole 34 and cooperates with a second stop 36 (in the form of an annular external shoulder) provided on a nozzle 35 which has a rear portion in the hole 41 and a front portion received partly in the section 42 and partly in the section 43 of the hole 34. The diameter of the hole 41 in the surface 40 can match the diameter of the larger-diameter section 42 of the hole 34 between the surfaces 31 and 50. The rear portion of the nozzle 35 is a snug fit in the hole 41, and this rear portion abuts and deforms an annular elastic sealing element 37 which abuts the bottom surface 48 and surrounds the inlet 46 of the nozzle. The latter further comprises at least one orifice 45 in the smaller-diameter section 43 of the hole 34 and at least one elongated passage 47 between the inlet 46 and the orifice 45.

The sealing element 37 is properly deformed to furnish a desirable sealing action when the device 38 is applied to properly couple the tool holder 33 to the base 32 (so that the plane surfaces 31 and 40 abut each other) and the nozzle 35 is inserted into the holes 34, 41 so that its external shoulder or stop 36 abuts the internal shoulder or stop 44 of the holder 33. The sealing element 37 prevents leakage of a fluid (e.g., cold water) from the discharge end 49 of a fluid-supplying channel 39 which is machined into the base 32 and receives fluid from a suitable source, not shown. The discharge end 49 of the channel 39 communicates with the inlet 46 of the nozzle 35 and is located centrally of the bottom surface 48 in the hole 41 of the base 32.

The shoulders 36, 44 prevent leakage of fluid and/or contaminants from the smaller-diameter section 43 into the larger-diameter section 42 of the hole 34 (and thence between the surfaces 31, 40), and the sealing element 37 prevents leakage of fluid from the channel 39, around the rear portion of the nozzle 35 and between the surfaces 31, 40.

The dimensions of the sealing element 37 are preferably selected in such a way that this element reliably maintains the shoulder 36 of the nozzle 35 in sealing engagement with the shoulder 44 of the tool holder 33. Thus, the sealing element 37 performs several functions including preventing leakage of fluid from the discharge end 49 of the channel 39, wobbling of the nozzle 35 in the holes 34 and 41, and leakage of fluid and/or contaminants from the section 43 into the section 42 of the hole 34. The nozzle 35 is automatically held in proper position (to ensure that the fluid which is supplied by the channel 39 can flow only into the passage 47) as soon as the sealing element 37 is inserted into the hole 41, the rear portion of the nozzle is inserted into the hole 41 above or in front of the inserted sealing element 37, and the coupling means 38 is applied to bias the surface 31 of the tool holder 33 against the adjacent surface 40 of the base 32. The nozzle 35 need not be provided with external threads, and the base 32 and/or the holder 33 need not be provided with internal threads for the nozzle because the nozzle is automatically centered and sealed in response to proper coupling of the holder 33 to the base 32 subsequent to insertion of the sealing element 37 and rear portion of the nozzle into the hole 41.

The hole 34 is parallel to and is adjacent the socket 51 so that the stream or jet of fluid issuing from the orifice 45 of the properly inserted nozzle 35 can impinge upon the working end of the material removing tool, the shank of which is held in the socket 51, or that such stream or jet can be directed upon the material which is being removed and/or that the jet or stream prevents the generation of excessive quantities of dust in the region where the machine employing the improved tool- and nozzle-holding or mounting device is being put to use.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A device for mounting a material removing tool for use in a mining machine, comprising a base having a first surface and a first hole in said surface; a tool holder having a second surface abutting said first surface and a through hole including a first section having a first cross-sectional area and being aligned with and adjacent said first hole and a second section having a smaller second cross-sectional area and being spaced apart from said surface, said tool holder further having a first stop between the first and second sections of said through hole; means for coupling said holder to said base; and a nozzle provided in said holes and having a second stop abutting said first stop, said nozzle having an orifice in the second section of said through hole, an inlet in said first hole and a passage between said inlet and said orifice, said base having a fluid-supplying channel which communicates with said inlet.

2. The device of claim 1, wherein said holes are cylindrical holes.

3. The device of claim 1, wherein said first stop includes an internal shoulder in said tool holder and said second stop includes an external shoulder on said nozzle.

4. A device for mounting a material removing tool for use in a mining machine, comprising a base having a first surface, a first hole in said first surface and a bottom surface in said first hole; a tool holder having a second surface abutting said first surface and a through hole including a first section having a first cross-sectional area and being aligned with and adjacent said first hole and a second section having a smaller second cross-sectional area and being spaced apart from said first and second surfaces, said bottom surface being remote from said first and second surfaces and said tool holder further having a first stop between the first and second sections of said through hole; means for coupling said holder to said base; a nozzle provided in said holes and having a second stop abutting said first stop; and deformable sealing means interposed between said bottom surface and said nozzle and being deformed by said nozzle and said base when said holder is coupled to said base and said second stop abuts said first stop.

5. The device of claim 4, wherein said base has a fluid-supplying channel including a discharge end in said bottom surface, said discharge end being surrounded by said sealing means.

6. A device for mounting a material removing tool for use in a mining machine, comprising a base having a first surface and a first hole in said surface; a tool holder having a second surface abutting said first surface and a through hole including a first section having a first cross-sectional area and being aligned with and adjacent said first hole and a second section having a smaller second cross-sectional area and being spaced apart from said surfaces, said tool holder further having a first stop between the first and second sections of said through hole; means for coupling said holder to said base; a nozzle provided in said holes and having a second stop abutting said first stop; and an annular elastic sealing element provided in said first hole and being maintained in sealing engagement with said nozzle and said base when said holder is coupled to said base and said second stop abuts said first stop.

7. The device of claim 6, wherein said nozzle has an inlet in said first hole and said base has a fluid-supplying conduit including a discharge end in communication with said inlet, said sealing element being arranged to seal said discharge end and said inlet from said through hole.

8. A device for mounting a material removing tool for use in a mining machine, comprising a base having a first surface and a first hole in said surface; a tool holder having a second surface abutting said first surface and a through hole including a first section having a first cross-sectional area and being aligned with and adjacent said first hole and a second section having a smaller second cross-sectional area and being spaced apart from said surfaces, said tool holder further having a first stop between the first and second sections of said through hole; means for coupling said holder to said base; a nozzle provided in said holes and having a second stop abutting said first stop, said stops being configurated to seal the first and second sections of said through hole from each other and said nozzle further having a fluid-admitting inlet in said first hole and a fluid-discharging orifice in the second section of said through hole; and means for sealing said inlet from the first section of said through hole.

9. A device for mounting a material removing tool for use in a mining machine, comprising a base having a first surface and a first hole in said surface; a tool holder having a second surface abutting said first surface and a through hole including a first section having a first cross-sectional area and being aligned with and adjacent said first hole and a second section having a smaller second cross-sectional area and being spaced apart from said surfaces, said tool holder further having a first stop between the first and second sections of said through hole and an additional surface, said through hole extending between said second surface and said additional surface and said holder further having a socket for a shank of a material removing tool which extends beyond said additional surface; means for coupling said holder to said base; and a nozzle provided in said holes and having a second stop abutting said first stop, said nozzle further having a fluid-discharging orifice in the second section of said through hole and said second section being adjacent said socket so that the fluid which is discharged by said orifice flows beyond said additional surface adjacent the tool having a shank in said socket.

10. A device for mounting a material removing tool for use in a mining machine, comprising a base having a first surface and a first hole in said surface; a tool holder having a second surface abutting said first surface and a through hole including a first section having a first cross-sectional area and being aligned with and adjacent said first hole and a second section having a smaller second cross-sectional area and being spaced apart from said surfaces, said tool holder further having a first stop between the first and second sections of said through hole; means for coupling said holder to said base, including means for biasing said surfaces against each other; and a nozzle provided in said holes and having a second stop abutting said first stop.

* * * * *